US005758436A

United States Patent [19]

Harms

[11] Patent Number: 5,758,436

[45] Date of Patent: Jun. 2, 1998

[54] SINGLE STAGE SNOWTHROWER

[75] Inventor: Clarence L. Harms, Brillion, Wis.

[73] Assignee: Ariens Company, Brillion, Wis.

[21] Appl. No.: 603,903

[22] Filed: Feb. 22, 1996

[51] Int. Cl.[6] ..... E01H 5/09

[52] U.S. Cl. ..... 37/249; 37/260; 37/262

[58] Field of Search ..... 37/244, 248, 249, 37/257, 260, 262; 193/15; D15/11, 12; 198/513, 676

[56] References Cited

U.S. PATENT DOCUMENTS

| | | | |
|---|---|---|---|
| Re. 33,726 | 10/1991 | Thorud et al. | 37/244 |
| D. 307,912 | 5/1990 | Yoshido et al. | D15/12 |
| 2,381,017 | 8/1945 | Wandscheer | 37/248 |
| 2,536,166 | 1/1951 | Garland | 37/260 X |
| 2,642,680 | 6/1953 | Curtis et al. | 37/43 |
| 2,714,772 | 8/1955 | Erickson | 37/248 |
| 2,768,453 | 10/1956 | Adams, Jr. | 37/43 |
| 3,213,552 | 10/1965 | Vanvick | 37/43 |
| 3,276,571 | 10/1966 | Vohl | 198/676 |
| 3,363,345 | 1/1968 | Ober | 37/43 |
| 3,398,470 | 8/1968 | Pool et al. | 37/281 X |
| 3,452,460 | 7/1969 | Cope et al. | 37/43 |
| 3,466,767 | 9/1969 | Rubin | 37/43 |
| 3,483,960 | 12/1969 | Wightman et al. | 37/260 X |
| 3,484,963 | 12/1969 | Heth et al. | 37/43 |
| 3,603,008 | 9/1971 | Heth | 37/43 |
| 3,742,626 | 7/1973 | Ellis | 37/260 |
| 3,762,537 | 10/1973 | Lutz | 198/676 X |
| 3,886,675 | 6/1975 | Maisonneuve et al. | 37/260 X |
| 4,203,237 | 5/1980 | Enters et al. | 37/43 |
| 4,322,896 | 4/1982 | Miyazawa et al. | 37/43 |
| 4,477,989 | 10/1984 | Vachon | 37/252 |
| 4,852,279 | 8/1989 | Gerbrandt | 198/676 X |
| 4,951,403 | 8/1990 | Olmr | 37/262 |

FOREIGN PATENT DOCUMENTS 644096 8/1962 Italy .

*Primary Examiner*—Randolph A. Reese
*Assistant Examiner*—Thomas A. Beach
*Attorney, Agent, or Firm*—Michael, Best & Friedrich LLP

[57] ABSTRACT

An improved single stage snowthrower includes a housing with an open front portion, the housing including two side walls, a rear wall therebetween and a discharge chute. The rear wall includes deflecting ledges that angle upwardly toward the discharge chute, inwardly toward the center of the housing and forwardly toward the open front. The deflecting ledges provide both an inward and an upward component to snow travelling in the housing. The snowthrower also includes an impeller having axial ends and a radial edge. The impeller is comprised of two molded identical body sections that are joined about a shaft. Each body section includes a central portion, two end portions and a pair of helical portions with one helical portion between each end portion and the central portion. A portion of the radial edge of the impeller includes a shovel-like projection that is oriented in a direction extending laterally away from the impeller in the direction of rotation of the impeller.

20 Claims, 4 Drawing Sheets

SINGLE STAGE SNOWTHROWER

FIELD OF THE INVENTION

The invention relates to single stage snowthrowers, and more particularly, to an improved impeller and impeller housing for such a snowthrower.

BACKGROUND OF THE INVENTION

Single stage snowthrowers are so named because they utilize only one powered implement, the impeller, for picking up and throwing snow outwardly away from the snowthrower. In contrast, two stage snowthrowers utilize two separate powered means for handling snow.

Single stage snowthrowers generally include a housing which is open to the front and an impeller which is positioned in the housing. The impeller must be relatively flexible and wear resistant to endure contact with hard surfaces and clean such surfaces without harm. Most impellers are designed using a planar sheet of flexible material held into a desired shape by metal components.

Single stage snowthrowers in order to have best control of placement of thrown snow must gather snow from a relatively wide path toward a centrally located narrower discharge chute and accelerate the snow to obtain a good throwing distance. For best snowthrowing, single stage snowthrowers must dig into relatively hard snow without recirculating the snow and must have an impeller shaped to gather and accelerate the snow in usually less than one half rotation of the snow on the impeller.

Single stage snowthrowers are generally lighter and less expensive than two stage snowthrowers but they generally do not throw snow as well, as far, or as controlled as do the two stage snowthrowers. Problems typically include overfeeding of the snow by the ends of the impeller to the center of the impeller so that snow is delivered to the center faster than the impeller can remove the snow from the housing via a discharge chute. Snow splitting or throwing of snow forwardly of the snowthrower is a problem with single stage snowthrowers. Further, conventional impellers tend to push snow straight along a surface or push snow upwardly before the snow reaches the center of the impeller.

SUMMARY OF THE INVENTION

The invention provides a single stage snowthrower having a housing with a generally open front, a pair of side walls, a rear wall and a discharge chute communicating with the rear wall. An impeller is mounted in front of the rear wall for rotation about a horizontal axis to propel snow with a component directed inward toward the center of the impeller and a component upward toward the discharge chute. The radial edge of the impeller defines a generally cylindrical path of rotation when the impeller is rotated about the axis of rotation. The rear wall has an arcuate portion adjacent each of the axial ends of the impeller and each arcuate end has a configuration complimentary to the cylindrical path of rotation of the impeller.

The rear wall of the housing has a forward portion and rearward portion that define a discharge chamber through which the snow passes from the impeller on its way to the discharge chute. The forward and rearward portions are connected by spaced deflecting ledges that extend at an angle to both the forward and rearward portions. The deflecting ledges have a lower end located beyond the axial ends of the impeller and located behind the impeller. The deflecting ledges slope from their lower end at an angle with a component inward toward the center of the impeller and a component upward toward the discharge chute.

The impeller is mounted on a shaft such that rotary motion is transmitted to the impeller. The impeller includes a molded body having first and second identically configured non-planar impeller body sections. Each impeller body section has a central portion, two end portions and two helical portions. The impeller body sections are secured together to form the impeller around the shaft. A portion of the outer radial edge of the impeller has a projection extending laterally therefrom in the direction of rotation of the impeller to provide a shovel-like configuration at the radial edge to aid in snow removal.

An object of the present invention is to provide an improved single stage snowthrower that more efficiently removes and throws snow.

Another object of the present invention is to provide a single stage snowthrower with an improved housing for the impeller.

Another object of the present invention is to provide a single stage snowthrower having a rear wall with a deflecting portion that extend beyond the ends of and behind the impeller.

Another object of the present invention is to provide a single stage snowthrower with an improved impeller.

Another object of the present invention is to provide a single stage snowthrower with a housing and an impeller that cooperate for more efficient snow throwing.

Another object of the present invention is to provide a single stage snowthrower having an impeller with a shovel-edge for more efficient snow removal and throwing.

Other features and advantages of the invention will become apparent to those of ordinary skill in the art upon review of the following detailed drawings, description and claims.

Figure 1:
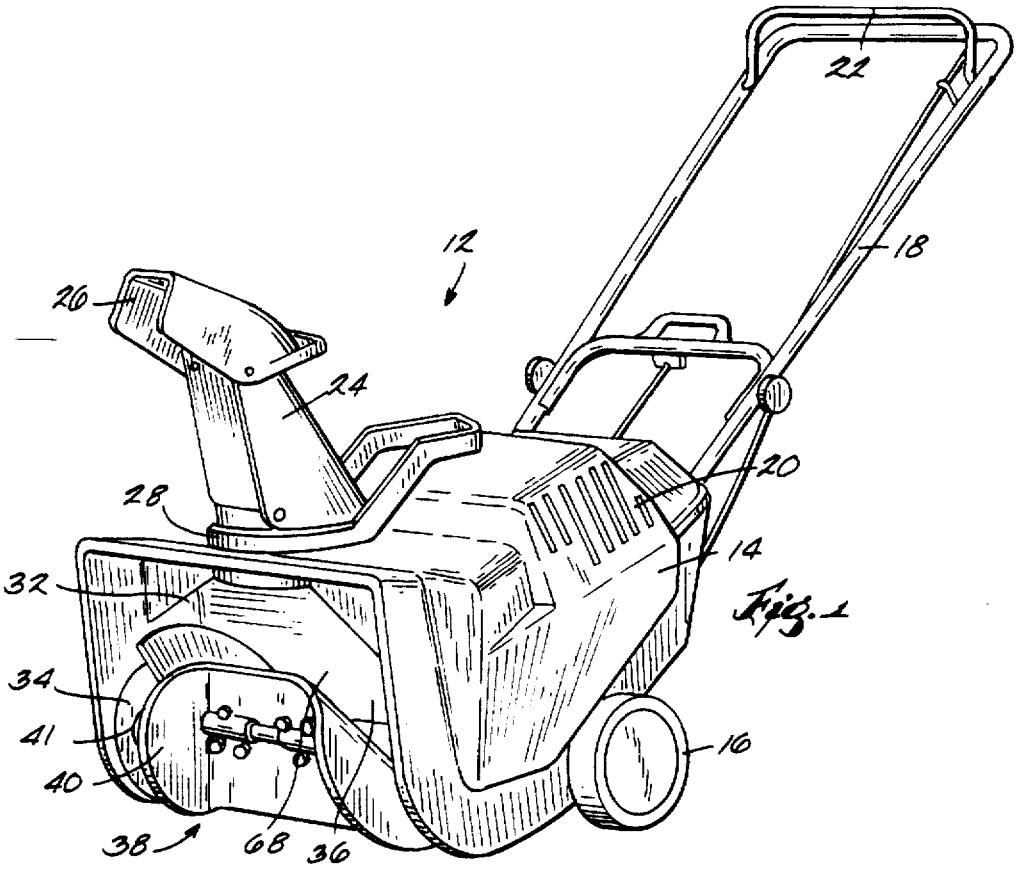
FIG. 1 is a perspective view of a single stage snowthrower embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown in FIG. 1 a single stage snowthrower 12 embodying the invention. The snowthrower 12 includes an outer housing 14 and a pair of wheels 16 supported by the outer housing 14. The wheels 16 assist in supporting the snowthrower 12 for movement across the ground. A handle 18 is connected to the outer housing 14. The handle 18 extends upwardly and generally at an angle for engagement by the operator to manipulate the snowthrower 12 over the ground and through the snow. A drive motor 20 is mounted within the outer housing 14 and is operatively connected to the wheels 16 to propel the snowthrower 12. A suitable arrangement of hand controls 22 is provided on the handle 18 for selectively engaging the drive motor 20 to operate the snowthrower 12. A discharge chute 24 is attached to the outer housing 14. The discharge chute 24 has an upper opening 26 and a lower generally circular opening 28. The discharge chute 24 is rotatable about a vertical axis to vary the orientation of the discharge chute 24 for snowthrowing purposes. The outer housing 14, wheels 16, motor 20 and discharge chute 24 are basic components of a single stage snowthrower and therefore they have only been generally shown and described.

An inner housing 32 is positioned within the outer housing 14. The inner housing 32 includes a pair of side walls 34 and a rear wall 36 therebetween. The side walls 34 and the rear wall 36 define an open front 38 of the snowthrower 12. The open front 38 allows the snowthrower 12 to be moved into engagement with an accumulation of snow to move the snow through the inner housing 32 and ultimately through the discharge chute 24. An impeller 40 is positioned within the inner housing 32. The impeller 40 has opposed axial ends 41.

Referring now to FIGS. 2–5 and with respect to the rear wall 36 of the inner housing 32, the rear wall 36 is the portion of the inner housing 32 that is both behind and behind and above the impeller 40. The rear wall 36 is defined by the following portions; a central or back wall 42, a pair of deflecting walls or ledges 44, a pair of center or transitional walls 46 and a pair of end walls 48. More specifically and with reference to FIG. 4, the back wall 42 is generally triangular in shape and tapers upwardly. The back wall 42 has two side edges 50, a lowermost edge 52 and an uppermost edge 54. The back wall 42 at its uppermost edge 54 communicates with the lower opening 28 of the discharge chute 24. The configuration of the back wall 42 is such as to enhance the movement of the snow upwardly through the discharge chute 24.

Figure 5:
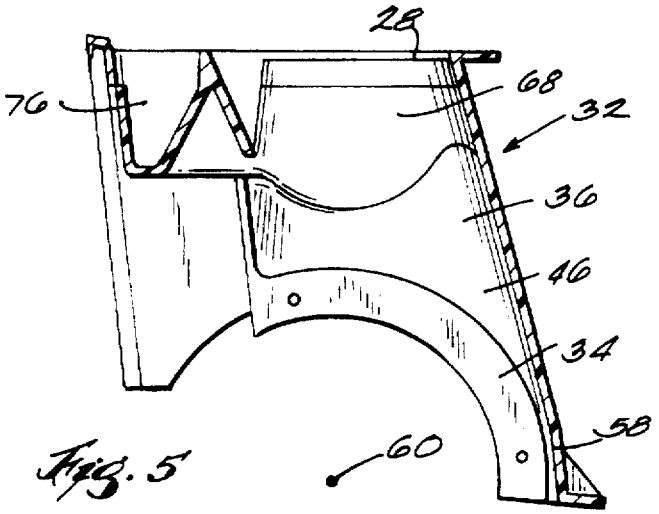
FIG. 5 is side sectional view of the inner housing.

Continuing forwardly from the back wall 42 toward the open front 38 of the snowthrower 12, one deflecting wall 44 is located on each side edge 50 of the back wall 42. Each of the deflecting walls 44 extends forwardly with respect to the back wall 42 and inwardly toward the discharge chute lower opening 28. The deflecting walls 44 are generally triangular shaped and taper downwardly. At their uppermost edge 56, the deflecting walls 44 communicate with the lower opening 28 of the discharge chute 24. At their lowermost corner or point 58, the deflecting walls 44 extend beyond the axial ends of the impeller 40 that is housed in the inner housing 32 and terminate behind, and not above the impeller 40. Preferably, the lowermost corner 58 of the deflecting walls 44 terminates in an area adjacent the area of an axis of rotation of the impeller 60 (FIG. 5). Accordingly, each deflecting wall 44 is configured and positioned such that it extends upwardly from a point beyond the axial ends 41 of the impeller 40 and from a point behind the impeller 40.

Continuing forwardly with respect to the deflecting walls 44, one transitional wall 46 is located on each forward edge 62 of a respective deflecting wall 44. The transitional walls 46 extend forwardly with respect to the deflecting walls 44 and also extend angularly inwardly and upwardly with respect to the ultimate path of travel of the snow through the snowthrower 12. The transitional walls 46 have a lowermost edge 64 and an uppermost edge 66. The uppermost edge 66 communicates with the lower opening 28 of the discharge chute 24. The back wall 42, deflecting walls 44 and transitional walls 46 cooperate to define an angular chamber 68 through which snow travels on its way to the discharge chute 24 from the impeller 40.

Figure 9:
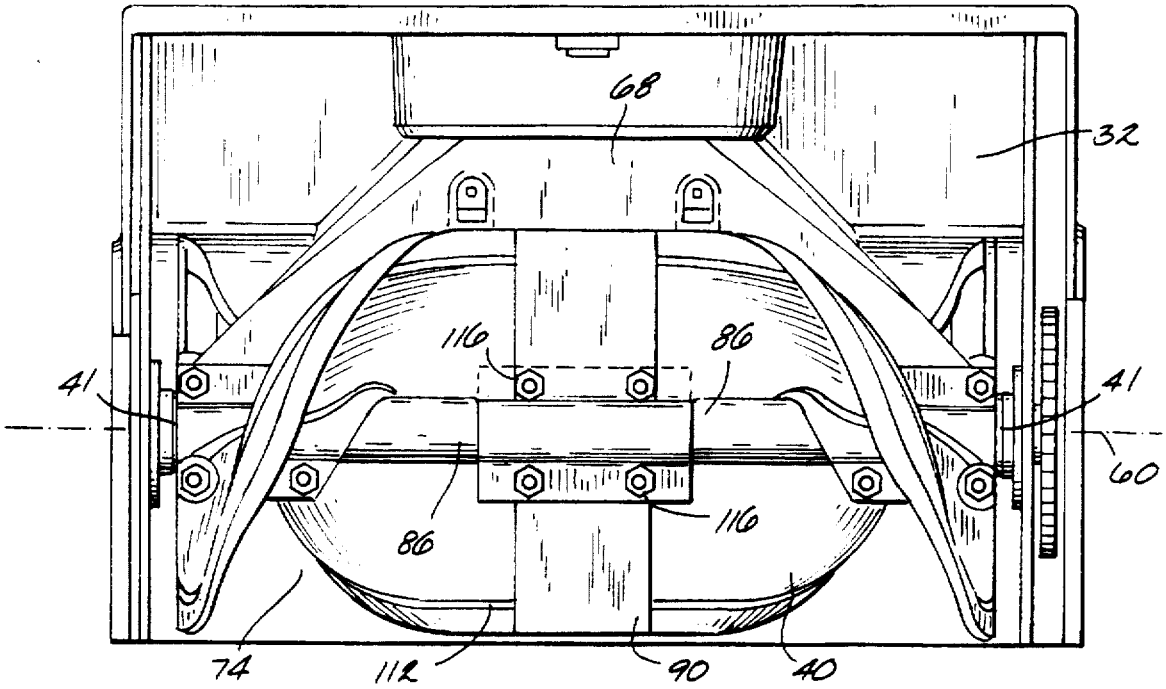
FIG. 9 is front view of the impeller mounted in the inner housing.

Referring now to the end walls 48, the rear wall 36 is comprised on a pair of arcuate end walls 48 that are positioned forwardly of the back wall 42. One end wall 48 is positioned between each side wall 34 and a transitional wall 46. Specifically, the end walls 48 have an inner edge 70 and an outer edge 72. The inner edge 70 of each end wall 48 abuts the lowermost edge 64 of a respective transitional wall 46. The outer edge 72 of each end wall 48 abuts a respective side wall 34. The end walls 48 are provided with an arcuate surface of limited and defined axial extension. The curvature of the end walls 48 corresponds to the circumference defined by the radial edge of the impeller 40 as the impeller 40 rotates. In other words, the center of curvature of each of the end walls 48 is coincident with the axis of rotation 60 for the impeller 40. Each end wall 48 also closely fits the outer periphery of the axial ends of the impeller 40, that is, the clearance between the impeller 40 and the end walls 48 is small so that the snow engaged in the impeller 40 is confined to the impeller 40 for most effective movement of the snow through the inner housing 32 (FIG. 9). The end walls 48 and the back wall 42 cooperate to define an impeller chamber 74 in which the impeller 40 is mounted and rotates.

The configuration of the inner housing 32 increases the snowthrowing efficiency of the snowthrower 12 in that snow is not recirculated in the inner housing 32. Rather, snow entering the impeller chamber 74 through the open front 38 is quickly moved to the center of the impeller 40 and accelerated through the angular chamber 68 to more effectively remove the snow in less than one half rotation of the snow on the impeller 40.

Figure 4:
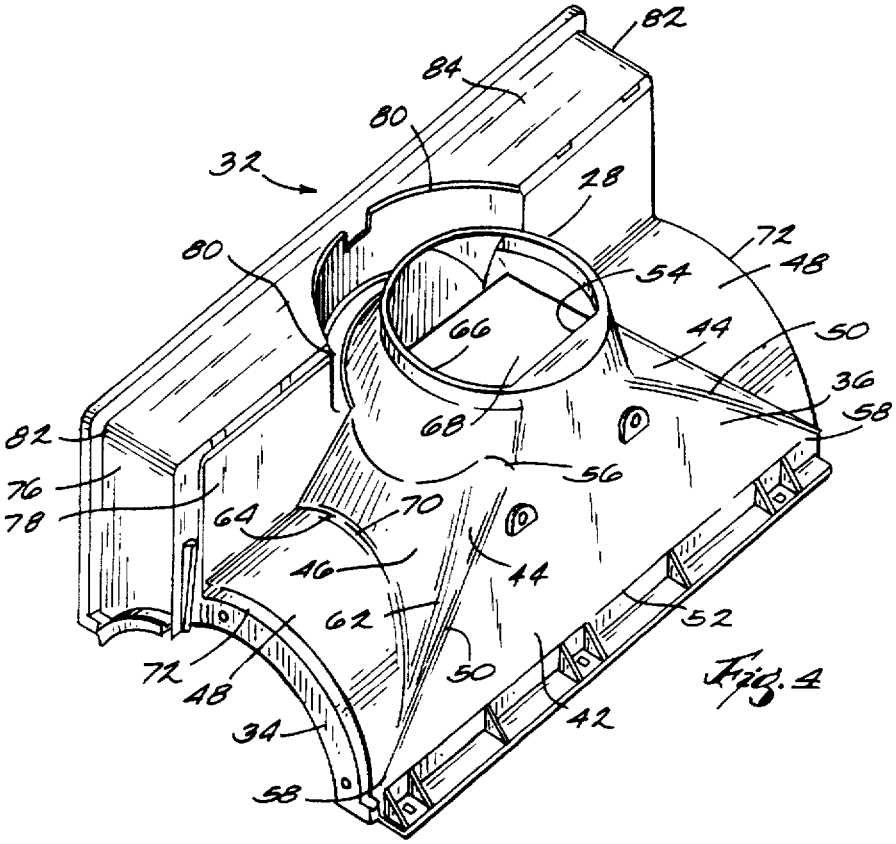
FIG. 4 is perspective view of the inner housing.
Figure 2:
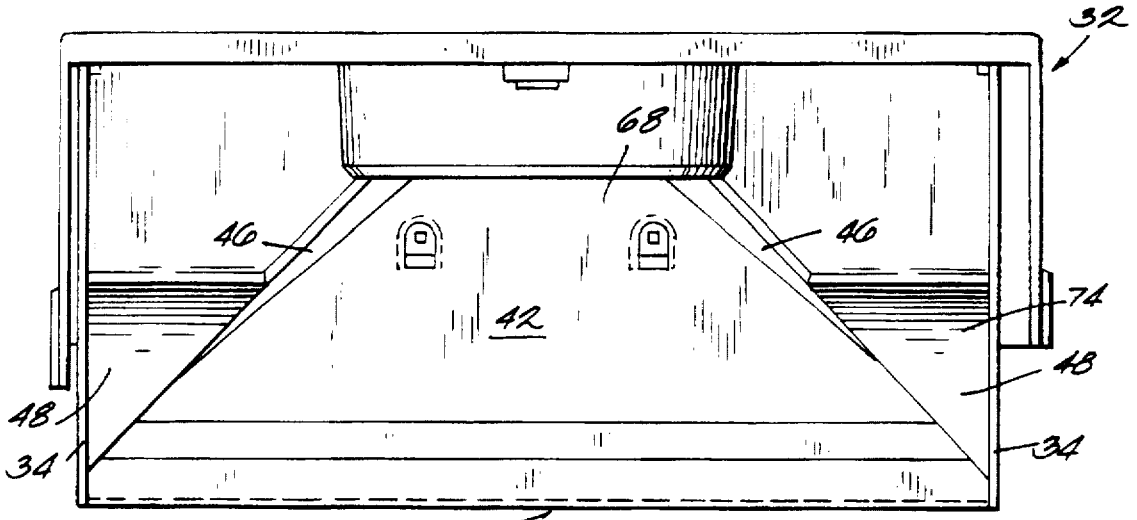
FIG. 2 is front elevational view of the inner housing.
Figure 3:
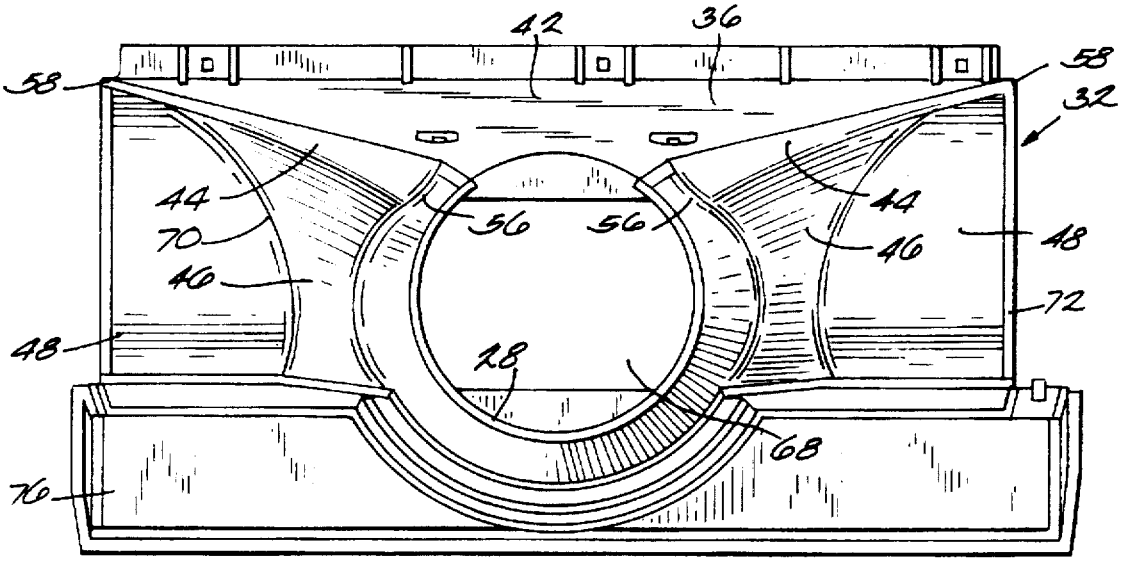
FIG. 3 is top view of the inner housing.

As best shown in FIG. 4, the inner housing 32 also includes a top shelf portion 76. The shelf portion 76 includes a vertical wall 78 that abuts with the end walls 48 and the transitional walls 46. The wall 78 has an arcuate relieved area 80 into which the discharge chute 24 extends. A pair of side walls 82 abuts with the wall 78 on each end of the wall 78 and a top wall 84 extends between the side walls 82 and abuts the wall 78. The top wall 84 also has therein a relieved area 80 into which the discharge chute 24 extends.

Referring now to FIG. 9 and to the impeller 40 housed within the impeller chamber 74 of the inner housing 32, the impeller 40 is supported for rotation within the impeller chamber 74 and rotates about the horizontal rotational axis 60. Specifically, the impeller 40 is mounted in the impeller chamber 74 on a shaft 86 with suitable bearings (not shown) and is connected via the shaft 86 and a belt and pulley arrangement (not shown) to the drive motor 20. The impeller 40 is configured such that as snow enters the impeller chamber 74, the snow in the center of the chamber 74 is propelled upwardly through the angular chamber 68 then through the discharge chute 24 and the snow at either end of the impeller chamber 74 is moved first axially inwardly toward the center of the impeller 40 and then upwardly through the angular chamber 68 and the discharge chute 24.

Figure 6:
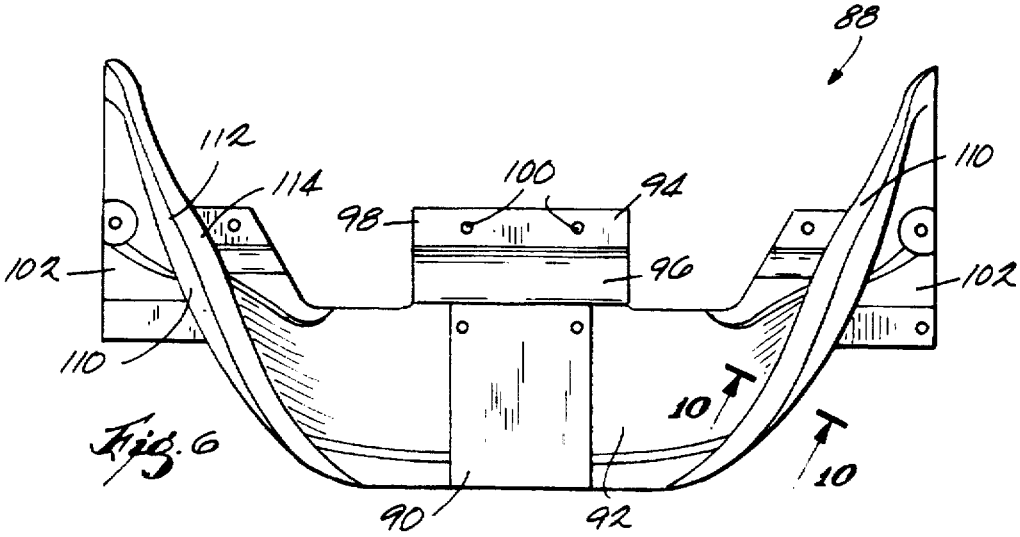
FIG. 6 is a top view of one impeller section.
Figure 7:
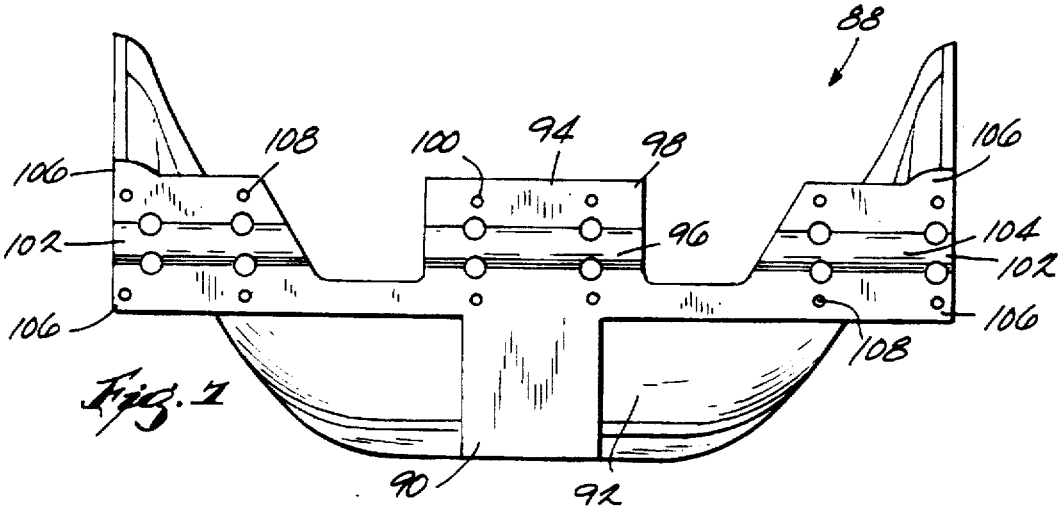
FIG. 7 is bottom view of one impeller section.
Figure 8:
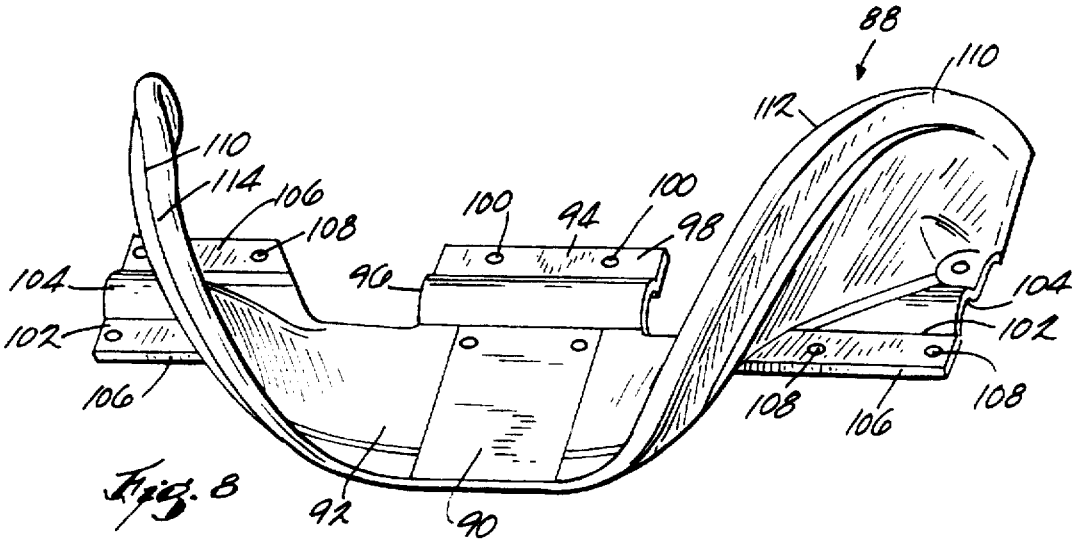
FIG. 8 is a perspective view of one impeller section.

Referring now to FIGS. 6–8, the impeller 40 itself is made of two identical non-planar pre-molded impeller body sections 88. The impeller body sections 88 are pre-molded with a preferred configuration as shown best in FIG. 8. The impeller body sections 88 are molded of a material such as a polyurethane and preferably are of a 0.25" thickness. The impeller body sections 88 are molded with sufficient internal inherent rigidity to hold the pre-molded shape and therefore do not have to rely on any auxiliary brackets to either initially shape the impeller sections or to maintain the impeller shape. The impeller body sections 88 are durable enough to withstand continued contact with the ground yet pliable enough to be able to bend if an obstruction is struck. It should be noted that the impeller body sections 88 can be molded of other materials such as rubber, vinyl or other thermoplastic elastomers.

Each impeller body section 88 being molded into its desired final shape is advantageous in that only one molded piece need be manufactured. Further, the one-piece molded impeller body section 88 is advantageous in that the shape of the impeller 40 is not compromised by construction requirements. The shape of the impeller 40 is pre-molded such that the efficient snowthrowing shape will not be compromised during assembly or use.

The specific configuration of the preferred embodiment of the impeller body sections 88 is as follows. Each impeller body section includes a generally planar central paddle portion 90 which is made up of a first and a second generally straight, aligned members 92 and 94 which extend radially relative to the axis of rotation 60. The first member 92 forms the central snowthrowing surface from which snow in thrown upwards into the angular chamber 68. The second member 94 has an arcuate portion 96 and a flange 98 having therein two apertures 100. The central portion 90 engages and propels the snow rearwardly and ultimately upwardly toward and through the angular chamber 68 and the discharge chute 24. Each impeller body section 88 also includes a pair of end portions 102 positioned one on each end of the impeller body sections 88. Each end portion 102 has an arcuate portion 104 as well as a pair of opposed flanges 106 with each flange 106 having therein two apertures 108.

Each impeller body section 88 further includes a pair of spiral or helical portions 110 with one helical portion 110 between each end portion 102 and the central portion 90. The helical portions 110 form a helix on the ends of the impeller 40. The formed helix is a variable rate helix rather than a constant helix. The variable rate helix aids in starting snow movement toward the center of the impeller 40 thus increasing snow removal efficiency. The helical portions 110 project laterally or radially relative to the axis of rotation 60 and spiral inwardly toward the central portion 90 about the axis of rotation 60. The helical portions 110 engage the snow and impart an axial component to the snow tending to move the snow inwardly toward the central portion 90 of the impeller 40.

Figure 10:
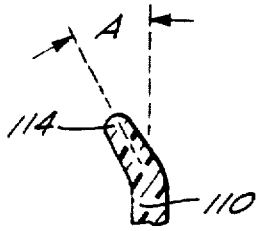
FIG. 10 is a cross section view of the impeller.

The impeller body sections 88 also include a shovel-like configuration on a portion of their outer radial edge 112 in the area of the helical portions 110. As best shown in FIGS. 6 and 10, the shovel-like configuration includes a projection or shovel edge 114 which extends laterally from what would be the normal spiral configuration of the helix. The shovel edge 114 projects from the radial edge 112 of a portion of each helical section 110 at an angle A to that normal extension. The angle A of the shovel edge 114 is in the direction of rotation of the impeller 40. Preferably, the angle A is on the order of about 60° and the shovel edge 114 has the same thickness as the corresponding helical portion 110. The shovel edge 114 gives the impeller 40 a somewhat cup-shaped configuration along its radial edge 112 that does not impede snow movement, but rather, aids in snow movement in the inner housing 32 as follows.

The shovel edge 114 of the impeller 40 is advantageous because it increases the degree of rigidity of the radial edge 112 so that the edge 112 can cut through snow and also provide a surface which in effect engages the snow with more of a cutting or shoveling action as opposed to what a normal straight edge impeller would provide. That is, the radial edge 112 of the impeller 40 without the shovel edge 114 would merely slap at the snow being engaged whereas the shovel edge 114 of the present invention with the resulting cup-shaped arrangement scoops the snow as well as penetrates or digs into the snow for more efficient snow removal. Further, the shovel edge 114 assists in guiding the snow toward the axis of rotation 60 of the impeller 40 and aids in preventing recirculation as the snow moves toward the central portion 90 of the impeller 40.

To assemble the two identical impeller body sections 88 about the shaft 86 as shown in FIG. 9, the two impeller body sections 88 are joined together by bringing the respective flanges 98 and 106 of one impeller body section 88 into engagement with the flanges 98 and 106 of the other impeller body section 88 and then inserting fasteners 116 through the apertures 100 and 108 and tightening the fasteners 116 to maintain the connection. More specifically, the two impeller body sections 88 are oriented such that the arcuate portions 96 of the central portion 90 cooperate to form a cylindrical bore through which the shaft 86 can be positioned. In this orientation, the arcuate portions 104 of the end portions 102 also cooperate to form the bore through which the shaft 86 is placed. The apertures 108 on the end portions 102 align as do the apertures 100 in the central portion 90. After the two impeller body sections 88 have been oriented as such, the fasteners 116 such as nuts and bolts, are utilized to secure the impeller body sections 88 about the shaft 86 in the desired orientation. It should be noted that any type of fastener could be used to secure the two impellers body sections 88 together about the shaft 86 such as self-tapping screws into plates, rivets, or staples.

With the arrangement of the impeller 40 being comprised of two identical pre-molded impeller body sections 88, a truer, more operationally effective configuration of the helical portions 110 as well as the central portion 90 can be provided to the impeller 40 than would be achieved if the impeller shape was being formed by the combination of a flexible impeller shaped and held in operative position by plates or brackets.

When the impeller 40 is mounted into the impeller chamber 74 of the inner housing 32, the impeller 40 is mounted such that the radial edge 112 of the impeller 40 engages the ground as it is moves into the accumulated snow. The ground engagement by the impeller 40 has two well recognized functions, one is it cleans the snow down to the surface and second the engagement with the ground assists in propelling the snowthrower 12 over the ground.

The interaction of the impeller 40 and the inner housing 32 is important to efficient snow removal. The cooperation of the impeller 40 and the inner housing 32 is exceptionally efficient in that by directing the snow over the entire width of the impeller 40 toward the central portion 90, maximum efficiency is achieved with approximately one-half turn of the impeller 40.

With the arrangement of the impeller 40 in the inner housing 32 of the snowthrower 12 of the present invention, snow is picked up at the ends of the impeller 40 and is confined very quickly by the curvature of the arcuate end sections 48 such that the helical sections 110 of the impeller 40 can exert enhanced axial forces on the snow being engaged. In addition, the snow which has been picked up by the helical portions 110 is very quickly exposed to the deflecting walls 44 of the inner housing 32 which also influence the inward movement as well as the upward movement of the snow being propelled. Thus, snow is moved extremely efficiently and rapidly to the central portion 90 of the impeller 40 where it can be effectively discharged up and out of the discharge chute 24 through the angular chamber 68.

In this regard, it will be noted that the deflecting walls 44 of the rear wall 36 extend upwardly from a point beyond the axial ends 41 of the impeller 40 so that all of the snow which is engaged by the impeller 40 is brought as soon as possible under the influence of the respective deflecting walls 44, i.e., the snow is imparted by an upward and inward component in addition to that which is being imparted by the impeller 40. The deflecting walls 44 extend toward and terminate at the lower opening 28 of the discharge chute 24 so that the inward and upward component of the snow is maintained up to and through the discharge chute 24. The inward and upward slope of the deflecting walls 44 enables snow that tends to come tangentially off the impeller 40 to be guided by the deflecting walls 44 and urged up and through the discharge chute 24.

I claim:

1. A snowthrower comprising;

a housing having a generally open front and including a pair of side walls, a discharge portions and a discharge chute communicating with said discharge portion; and an impeller mounted in said housing for rotation about a horizontal axis, said impeller having axial ends, a center section, and a radial edge, said radial edge defining a generally cylindrical path of rotation when said impeller is rotated about said axis;

said discharge portion having an arcuate portion adjacent each of said axial ends of said impellers each arcuate portion having a configuration complimentary to the cylindrical path of rotation of said impeller, at least a portion of each of said arcuate portions, being above said impeller;

said discharge portion having a forward portion and rearward portion that define a discharge chamber of said housing, said discharge chamber in communication with said discharge chute, said forward and rearward portions being connected by at least one ledge extending at an angle to both said forward and rearward portions, said ledge having a lower end located beyond a respective one of said axial ends of said impeller and located behind said impeller, said ledge sloping from said lower end at an angle with a component inward toward said center section of said impeller and a component upward toward said discharge chute.

2. A snowthrower as set forth in claim 1 wherein said impeller has helical portions on said axial ends and wherein each of said helical portions is adjacent one of said arcuate portions of said housing.

3. A snowthrower as set forth in claim 1 and further including a shaft extending through said impeller and through which rotary motion is transmitted to said impeller, wherein said impeller includes first and second pre-shaped body sections, each body section having a central portion and two helical portions, wherein said impeller includes a connector, and wherein said body sections are secured together around said shaft with said connector to form said, impeller.

4. A snowthrower as set forth in claim 3 wherein a portion of said radial edge has a projection extending laterally therefrom in the direction of rotation of said impeller to provide a cup-like configuration at said radial edge.

5. A snowthrower as set forth in claim 3 wherein said first and second body sections are identical.

6. A snowthrower as set forth in claim 1 wherein said ledge is generally triangular and tapers downwardly.

7. A snowthrower as set forth in claim 1 wherein said arcuate portions, relative to said axis, extend from a point below a horizontal center line through said axis to a point above said axis and beyond a vertical center line through said axis.

8. A snowthrower as set forth in claim 1 wherein said rearward portion includes a generally triangular shaped back wall.

9. A snowthrower as set forth in claim 8 wherein said at least one ledge is two ledges, wherein said back wall has two side edges, and wherein one of said ledges is adjacent each of said side edges.

10. A snowthrower comprising:

a housing having a rear portion, first and second side walls spaced one from the other and extending from said rear portion to define an open front for said snowthrower, and a discharge opening communicating with said rear portion;

an impeller mounted in said housing for rotation about a horizontal axis, said impeller having axial ends, a center section and first and second end sections each having a helical portion spiraling between a respective one of said axial ends and said center section and each end section terminating in an outer axial edge, and wherein said discharge opening is positioned above said center section of said impeller, and said rear portion including a pair of deflecting walls and a central section bounded by said deflecting walls and extending toward and merging with said discharge opening, each of said deflecting walls having an upper end and a lower end, said lower end located outwardly beyond a plane which is perpendicular to said horizontal axis and which includes a respective one of said outer axial edges, and each deflecting wall sloping from said lower end at an angle with a component inward toward said center section and a component upward toward said discharge opening.

11. A snowthrower according to claim 6 wherein said rear portion includes an arcuate end portion adjacent each of said helical portions of said impeller, and wherein each of said arcuate end portions are complementary in shape to said helical portions.

12. A snowthrower of claim 11 wherein said arcuate end portions, relative to said axis, extend from a point below a horizontal center line through said axis to a point above said axis and beyond a vertical center line through said axis.

13. A snowthrower according to claim 10 wherein said central section includes a generally triangular back wall.

14. A snowthrower according to claim 10 wherein each of said deflecting walls slope at an angle with a component forward toward said open front and wherein said slope increases from said lower end toward said upper end.

15. A snowthrower according to claim 10 and further including a shaft extending through said impeller and through which rotary motion is transmitted to said impeller, wherein said impeller has a molded elastomer body comprising first and second identically configured pre-shaped impeller body sections, each impeller body section having a central generally planar portion, two generally planar end portions positioned one at each of said axial ends of said impeller and two helical portions, wherein said helical portions spiral from said respective axial ends to said central portion, wherein said impeller includes connector receiving means, and wherein said impeller includes a connector so that when said impeller body sections are joined by said connector at said connector receiving means, said impeller body sections form said impeller encircling said shaft.

16. A snowthrower housing comprising:

a discharge chute opening;

a back wall having an upper edge and first and second side edges, said upper edge communicating with said opening;

a deflecting wall extending forwardly and inwardly from each of said side edges of said back wall;

a transition wall extending forwardly from each of said deflecting walls, each of said transition walls having a lower edge; and a pair of arcuate end walls extending forwardly from said back wall, one of said end walls adjacent said lower edge of each of said transition walls.

17. A snowthrower housing as set forth in claim 16 wherein each of said deflecting walls are generally triangular and taper downwardly.

18. A snowthrower housing as set forth in claim 16 wherein said back wall is generally triangular.

19. A snowthrower housing as set forth in claim 16 wherein each of said transition walls communicates with said opening.

20. A snowthrower housing as set forth in claim 19 wherein each of said transition walls angle inwardly and upwardly toward said opening.

* * * * *

UNITED STATES PATENT AND TRADEMARK OFFICE

CERTIFICATE OF CORRECTION

PATENT NO. : 5,758,436

DATED : June 2, 1998

INVENTOR(S) : Clarence L. Harms

It is certified that error appears in the above-indentified patent and that said Letters Patent is hereby corrected as shown below:

Claim 1, column 7, line 28, "portions" should be --portion,--.

Claim 1, column 7, line 36, "impellers" should be --impeller,--.

Claim 11, column 8, line 44, "claim 6" should be --claim 10--.

Signed and Sealed this

Twenty-second Day of September, 1998

*Attest:*

Bruce Lehman

BRUCE LEHMAN

*Attesting Officer*

*Commissioner of Patents and Trademarks*